US005722704A

United States Patent [19]

Chaput et al.

[11] Patent Number: 5,722,704

[45] Date of Patent: Mar. 3, 1998

[54] MULTI-POINT DOOR LOCK

[75] Inventors: Ivanhoe E. Chaput, Redondo Beach; Petros Z. Mantarakis, Northridge, both of Calif.

[73] Assignee: Reflectolite Products, Inc., Sun Valley, Calif.

[21] Appl. No.: 636,379

[22] Filed: Apr. 23, 1996

[51] Int. Cl.[6] ..... E05G 7/00

[52] U.S. Cl. ..... 292/26; 292/56; 292/DIG. 46

[58] Field of Search ..... 292/26, 56, 116, 292/117, 118, 214, DIG. 46, 11, 30, 332

[56] References Cited

U.S. PATENT DOCUMENTS

| | | | |
|---|---|---|---|
| 1,216,765 | 2/1917 | Anderson | 292/26 |
| 2,701,157 | 2/1955 | Le Bon, III | 292/DIG. 46 |
| 2,712,464 | 7/1955 | Collar et al. | 292/126 |
| 2,736,185 | 2/1956 | Collar | 70/100 |
| 2,855,234 | 10/1958 | Eads | 292/DIG. 46 |
| 2,924,475 | 2/1960 | Russell | 292/DIG. 46 |
| 2,980,458 | 4/1961 | Russell | 292/DIG. 46 |
| 3,041,097 | 6/1962 | Eads | 292/DIG. 46 |
| 3,596,954 | 8/1971 | Hull et al. . | |
| 4,050,272 | 9/1977 | Tanaka | 70/100 |
| 4,068,874 | 1/1978 | Fleming et al. | 292/128 |
| 4,253,688 | 3/1981 | Hosooka | 292/52 |
| 4,434,635 | 3/1984 | Borgato . | |
| 4,643,005 | 2/1987 | Logas | 70/95 |
| 4,676,537 | 6/1987 | Esser . | |
| 5,388,875 | 2/1995 | Fleming | 292/37 |
| 5,542,720 | 8/1996 | Fleming | 292/32 |

FOREIGN PATENT DOCUMENTS 918429 2/1963 United Kingdom .

OTHER PUBLICATIONS

HTL Hardware Technologies Limited Brochure.

G–U Lift–Sliding Doors and Lift–Tilt–Sliding Doors Brochure.

G–U Hardware, Inc.—A New Degree of Perfection Brochure.

*Primary Examiner*—Steven N. Meyers
*Assistant Examiner*—Gary Estremsky
*Attorney, Agent, or Firm*—Renner, Otto, Boisselle & Sklar, P.L.L.

[57] ABSTRACT

A door lock has a latch which is rotatable from a retracted position to an extended position by means of a linkage. A safety button extends from the latch when the latch is retracted. The linkage cannot be moved unless the safety button has been pressed, which occurs when the door is adjacent the door frame. This prevents the latch from extending and so damaging the keeper in the door frame. The linkage also has a notch which cooperates with a tang projecting from the housing. The tang an notch prevent the latch from being rotated from the extended position to the retracted position except by operation of the linkage. This feature makes it difficult to force the lock open without a key. In addition, one or more remote locks may be added to the main lock. With two remote locks it is possible to provide three anchor points for a door. Further, the remote locks are individually adjustable so that the reach of the latches can be varied to suit the configuration of the door frame or door, and so to accommodate irregularities due to installation or warpage. One of the remote locks can rotate in the opposite direction from the main lock so that the door cannot be lifted off its track.

46 Claims, 4 Drawing Sheets

MULTI-POINT DOOR LOCK

FIELD OF THE INVENTION

The present invention relates to door locks for patio doors.

BACKGROUND OF THE INVENTION

Multi-point door locks have as a principal purpose to permit a sliding door or a French door to be securely closed and locked. There are a number of design considerations on the way to this goal. First it is advantageous if the lock interfaces properly with handles that are already on the market. In this way consumers can choose any style of handle they desire while still enjoying the use of the lock of their choice.

It may also be helpful for the lock to have more than a single latch to engage the door frame. Plural latches produce a lock that is more difficult to force open than a single latch system. In this regard it is desirable for a patio door lock to have one or two or three latches, depending on the particular application, and further for the design to permit the addition of latches without changes to the basic or main locking unit. Moreover, the additional latches should be able to accommodate easily doors of various heights.

An additional consideration is to avoid some of the difficulties that have affected prior art patio door locks. For example, on some door locks, it is possible for the latch to be extended even when the door is open. If the door is slammed shut while the bolt is extended, the bolt and its strike plate or keeper in the door jamb may both be damaged, with the result that the door cannot be locked. Further, a multi-point door lock must be able to accommodate door frames that are not perfectly straight or that warp over time. This requires that the latches be independently adjustable.

Some multi-point door locks have a latch that engages a striker plate at about the middle of the door's height and two bolts which move vertically into openings in the horizontal top and bottom members of the door frame. These bolts often to not seat properly because the installer does not properly locate the openings in the door. In addition, dirt and debris can collect in the bottom of the lower hole, preventing the bolt from seating properly. Moreover, should the door frame warp, the holes can go out of alignment and the lock may become unusable. Installers try to compensate for these problems by drilling the holes oversized, but this results in a loose fit and a door that is not held tight to the door frame. Latches which engage a keeper on the jamb and hold the door fully closed are preferable because they are more likely to produce a tight seal and have fewer alignment problems.

SUMMARY OF THE INVENTION

The present invention provides an improved multi-point door lock for patio or other sliding doors. The present invention includes a main lock and one or two remote locks. The latch of the main lock and its striker plate are protected in that the latch cannot be extended unless the door is actually closed. The main lock is tamper resistant in that once it is latched, the latch cannot easily be moved to an unlatched position except by the lock actuator. In other words, a burglar would find it difficult to insert a knife in between the door and door frame and then force the latch into its open position. In addition, one or two remote locks may be added, and each of these is independently adjustable to accommodate variations in the shape of the door frame or jamb. The remote locks may be added at various locations to accommodate doors of different heights. The remote locks may be added with the hook portion of their latches facing in opposite directions so that the door cannot be lifted off its track to gain unauthorized entry.

These and other advantages and features of the present invention will be apparent to those of skill in the art from the following specification and drawings. The invention, however, is limited only by the scope of the claims which follow.

DESCRIPTION OF PREFERRED EMBODIMENTS

Figure 1:
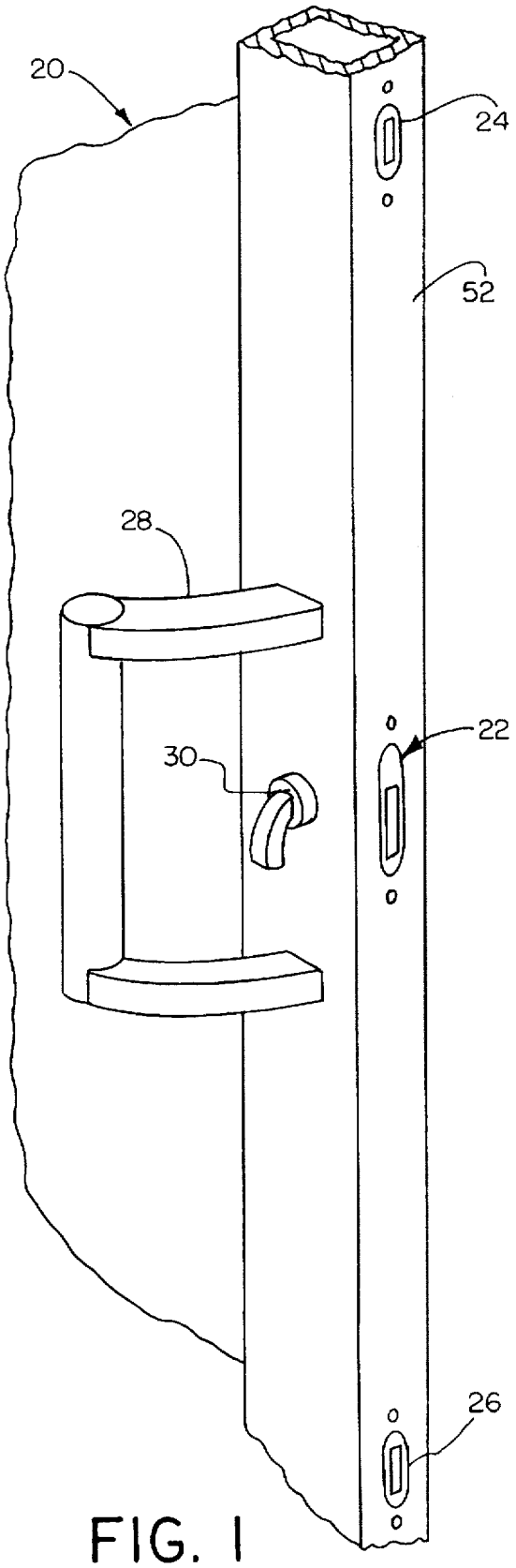
FIG. 1 is a perspective illustration of a patio door, partially cut away and fitted with a multi-point door lock assembly constructed in accordance with the present invention and including a main lock and upper and lower remote locks.

The door 20 illustrated in FIG. 1 includes a lock assembly constructed in accordance with the present invention. The lock assembly includes a main lock 22 and upper and lower optional remote locks 24 and 26, respectively. The door 20 includes a handle 28 and a lock actuator 30. Both of these latter two elements are entirely conventional and need no further description. The door 20 is a conventional, sliding patio door. When the door 20 is moved to a closed position, the actuator 30 can be turned to actuate the main and remote locks 22, 24, and 26 to secure the door against unauthorized entry.

Figure 2:
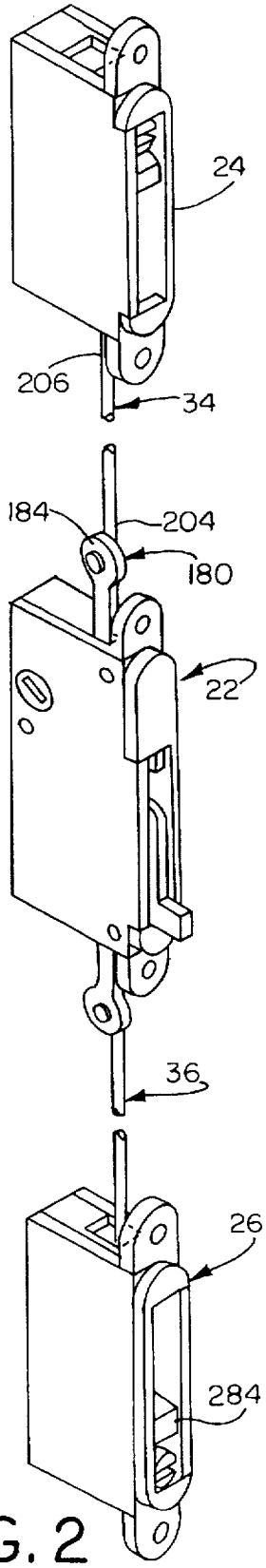
FIG. 2 is a perspective illustration of the patio door lock assembly of FIG. 1 showing just the main lock, the two remote locks and the rods that link them.

FIG. 2 shows the main lock 22, the upper and lower remote locks 24 and 26, respectively, and the upper and lower connecting rods 34 and 36, respectively, which connect them. When the main lock 22 is actuated by rotation of the actuator 30, the motion is transmitted through the rods 34 and 36 to the remote locks 24 and 26, respectively.

Figure 3:
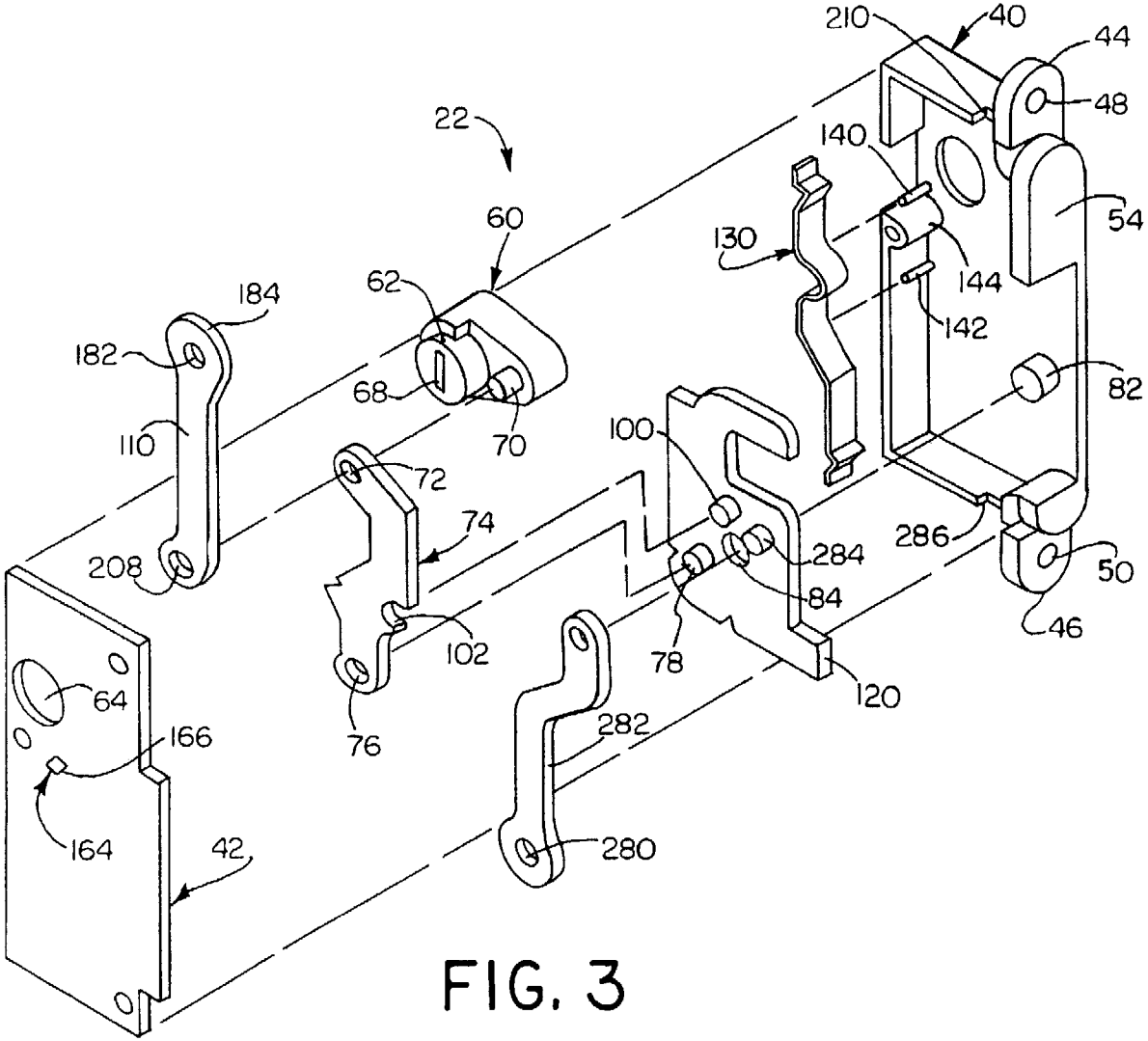
FIG. 3 is an exploded perspective illustration of the main lock of FIGS. 1 and 2.

The main lock 22 (FIG. 3) includes a housing 40 which mounts and supports the various pieces of the main lock. The housing 40 is closed by a cover plate 42. The housing 40 includes two bosses 44 and 46 which have threaded holes 48 and 50 for mounting the lock 22 in a door such as the door 20 shown in FIG. 1. The door 20 is characterized by having a hollow channel section 52 for its vertical member so that the locks 22, 24, and 26 may be inserted. If the door 20 is a solid door, then channels for the main lock 22, remote locks 24 and 26, and the rods 34 and 36 can be formed in the door. These channels can subsequently be covered with a suitable strip of material secured to the door to cover the channels.

The bosses 44 and 46 are set back (to the left as viewed in FIGS. 3 and 4) from the front face 54 of the housing 40.

Typically the lock 22 is mounted inside a hollow channel section 52 (FIG. 1) making up part of the door 20. The front face 54 of the housing 40 is then flush with the outside surface of the channel 52, and machine screws (not shown) extend through openings on the channel 52 and into the threaded holes 48 and 50 (FIG. 2) to secure the housing to the channel 52. This mounting is entirely conventional, and it will be apparent to those skilled in the art that one of the advantages of the present invention is that no substantial changes are needed for most door manufacturers to be able to install the lock in the patio or sliding doors they presently manufacture.

A key crank 60 is mounted between the housing 40 and the cover 42. The key crank 60 includes a cylindrical bearing surface 62 which is rotatable in a cylindrical opening 64 in the cover plate 42. A corresponding bearing surface on the opposite side of the key crank 60 fits in the cylindrical opening 66 in the housing. The two openings 64 and 66 are coaxial when the cover plate 42 is installed on the housing 40, and the key crank 60 is rotatable on the bearing surface 62 and the corresponding bearing surface about the common axis of the openings 64 and 66.

The key crank 60 includes a slot 68 which extends through the key crank. This slot receives a conventional drive tang (not shown) which is part of and connected to the actuator 30 (FIG. 1 ). As is apparent to those familiar with the art, a key operated tumbler (not shown) may be used in place of or in addition to the actuator 30. When the actuator 30 is rotated, the key crank 60 rotates about the common axis of the openings 64 and 66, and as is described below, under certain circumstances this motion is transmitted to the other lock components to open or close the main lock 22 and the remote locks 24 and 26.

The key crank 60 has a crank pin 70 which is offset from the axis of rotation of the key crank and parallel to it. The crank pin 70 fits in an opening 72 in the upper end portion of a link 74, thus forming a pivotable connection between the key crank and link. The link 74 in turn includes a second opening 76 in its lower end portion which receives a pin 78 mounted to the latch 80. The latch 80 in turn is rotatably mounted in the housing 40 by means of a pin 82 projecting from the housing and a corresponding opening 84 in the latch. The result of this arrangement is that, subject to the details described below, when the lock actuator 30 is turned, the key crank 60 also turns, and its rotary motion is transmitted through link 74 to the latch 80 which in turn rotates to extend or retract the latch, depending on the direction of rotation of the lock actuator. In effect, the housing 40, the key crank 60, the link 74 and the latch 80 form a four bar linkage.

Figure 4:
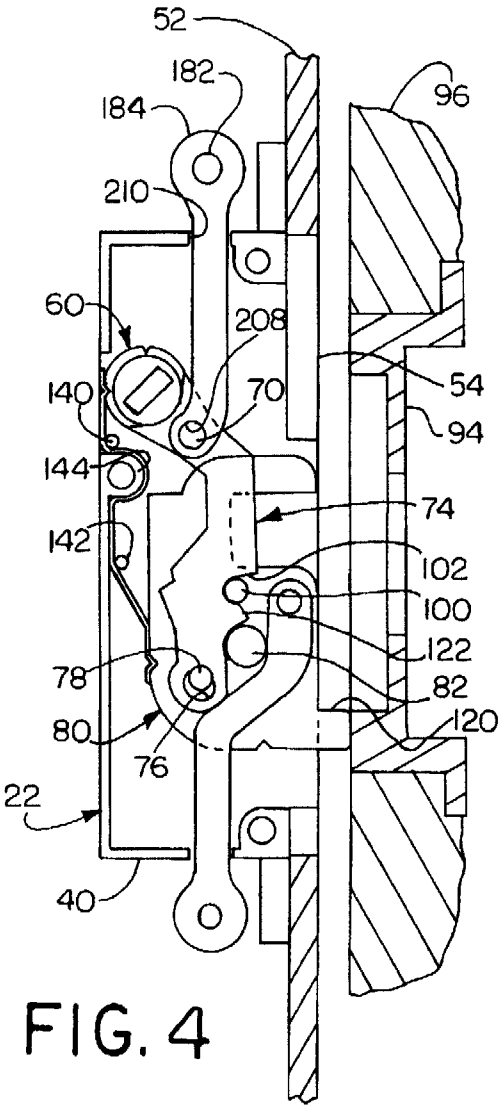
FIGS. 4 through 7 are elevation views of the main lock of FIG. 3 with the cover plate removed and showing in sequence the motion of the various components as the lock approaches and engages a striker plate.

The main lock 22 is shown in its open position in FIG. 4. The lock 22 is shown entirely free of contact with a striker plate 94 which is mounted in the door frame 96. In this position the operator 30 (FIG. 1) cannot rotate the key crank in either direction, which is explained as follows. If a torque is applied to turn the key crank 60 in a counterclockwise direction (as viewed in FIG. 4), the link 74 would be forced in its initial motion to rotate in a clockwise direction. This is because the crank pin 70 on the key crank 60 is at about a four o'clock position, and so counterclockwise motion of the key crank would include a component tending to move the pin 70 to the right as viewed in FIG. 4. Movement of the pin 70 to the right would in turn cause the top of the link 74 to move to the right, resulting in a clockwise initial motion for the link 74.

A safety pin 100 and cooperating safety slot 102 block any initial clockwise movement of the link 74 when the latch is in the fully open position shown in FIG. 4. The safety pin 100 extends from the latch 80 and is received in a safety slot 102 formed in the link 74. The safety slot 102 opens to the right and has a closed end which closely receives the safety pin 100. When the safety pin 100 is in all the way in the safety slot 102, the safety pin is able to move only to the right (or the slot to the left) as viewed in FIG. 4; relative vertical motion between the safety pin 100 and the safety slot 102 are prohibited other than the minimal clearance necessary to allow the parts to have a sliding fit. Therefore, in the open position shown in FIG. 4, the safety pin 100 is positioned in the back end (i.e., the left end as viewed in FIG. 4) of the safety slot 102. Unless the safety pin 100 is moved out of the safety slot 102, the link 74 cannot move toward the right as viewed in FIG. 4.

The safety pin 100 is mounted on the latch 80 which rotates about the fixed pin 82. If the latch 80 is rotated clockwise about the pin 82, the safety pin 100 would be moved out of the safety slot 102. However, an initial rotation of the key crank 60 in the counterclockwise direction does not initially tend to cause any rotation of the latch 80 which might move the safety pin 100 out of the safety slot 102. This is achieved by means of a lost motion connection between the link 74 and the latch 80.

Specifically, as shown in FIG. 4, the opening 76 in the lower end of the link 74 is larger than the diameter of the pin 78, and when the key crank 60 is in the position shown in FIG. 4, there is "extra space" in the opening 76 below and to the left of the pin 78. The opening 76 is what may be termed a tri-oval. Where the pin 78 is 0.125 inches in diameter the opening 76 permits a total movement in the vertical direction (as viewed in FIG. 4) of 0.069 inches, and to the left a maximum of 0.030 inches.

As a result of lost motion connection between the link 74 and latch 80 and the safety pin 100 in the safety slot 102, the key crank 60 cannot be turned counterclockwise from the position shown in FIG. 4. The safety pin 100 in the safety slot 102 blocks any movement of the link 74 in the necessary direction, and the lost motion between the second opening and the pin 78 prevents any compensatory motion of the latch which might draw the safety pin out of the safety slot. Thus it is not possible to cause the latch 80 to move from its fully retracted position shown in FIG. 4 by rotating the key crank counterclockwise.

Rotation of the key crank 60 in the clockwise direction from the position shown in FIG. 4 is also prevented when the main lock 22 is in the fully open position shown in FIG. 4. Initial rotation of the key crank 60 clockwise from the FIG. 4 position would cause the crank pin 70 to move downward and to the left. Such movement of the crank pin 70 would impart a similar motion to the top portion of the link 74. Under these circumstances the safety pin 100 again blocks movement of the link 74. This is so because any downward movement of the link 74 would cause the lower portion of the link to move to the right as the latch rotates counterclockwise. Such movement is prohibited by interference between the link 74 and the fixed pin 82.

Because the crank arm 60 cannot be turned in either direction from the position shown in FIG. 4, the latch 80 cannot be accidentally extended and crashed into the striker plate 94 which is mounted in a vertical member 96 of the door frame. The main lock 22 is essentially locked open.

The main lock 22 can only be locked by rotation of the crank arm 60 after the latch 80 has been dislodged from the position shown in FIG. 4. This is accomplished by pressing the safety button 120. The safety button 120 projects out from the latch 80 below the center line of opening 84, and when the latch is in the fully open position illustrated in FIG. 4, the safety button 120 is the only part of the latch that projects outward (to the right as viewed in FIG. 4) beyond the front face 54 of the housing 40. The safety button 120 is proportioned so that as the lock 22 is moved toward the striker plate 94, the safety button will contact the striker plate and rotate the latch clockwise toward the position shown in FIG. 5.

Figure 5:
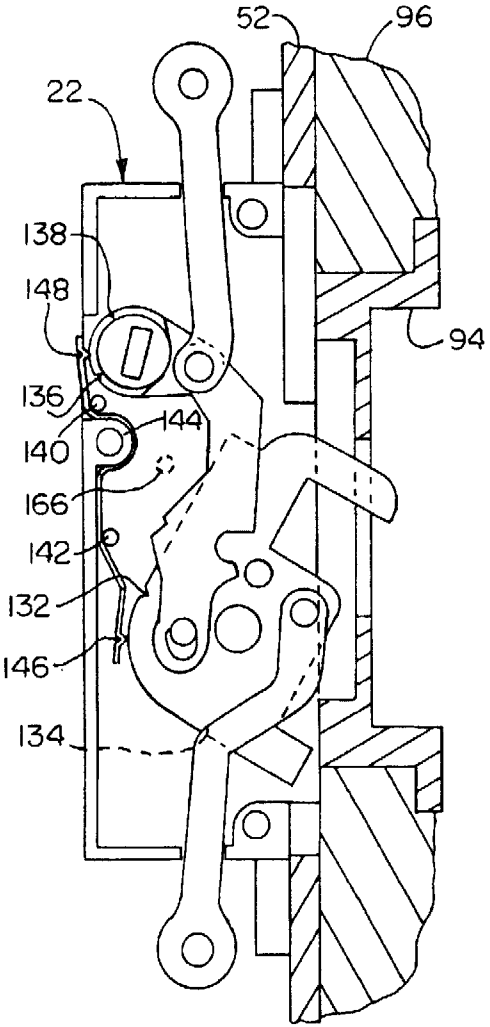

The initial movement of the latch 80 from the FIG. 4 position to that shown in FIG. 5 releases the safety pin 100 from the safety slot 102. This occurs because the initial movement of the latch 80 causes both the pin 78 and the safety pin 100 to rotate with the latch 80 about the axis of the fixed pin 82. Because the pin 76 is farther from the fixed pin 82 than is the safety pin 100, and because a large component of the initial displacement of the pin 78 is to the left while a smaller component of the initial displacement of the safety pin 100 is to the right, the safety pin 100 is able to follow the contour of the bottom edge 122 of the safety slot 102.

Figure 6:
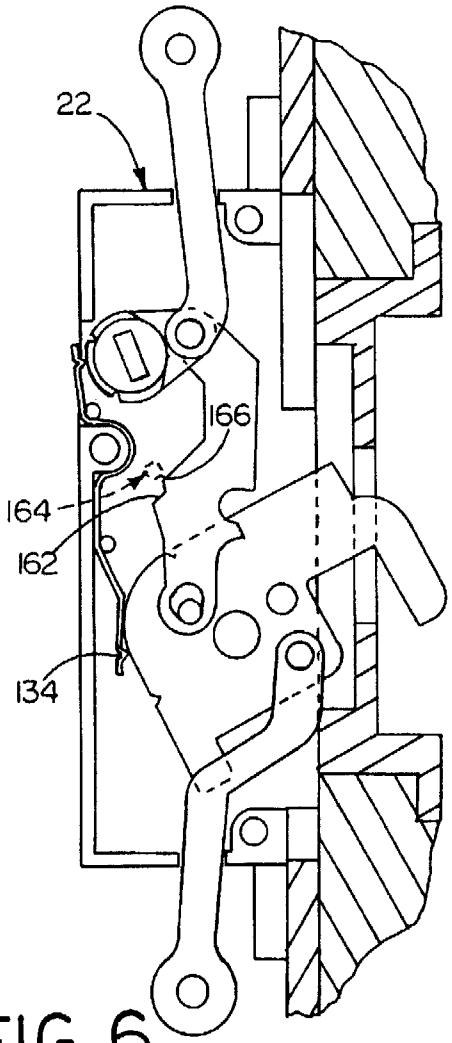

As noted above, once the safety pin 100 is clear of the safety slot 102, the key crank 60 may be turned counterclockwise to move the latch 80 toward its extended position. When the key crank 60 is rotated counterclockwise, the link 74 moves upward until the "extra space" in the second opening 76 is above the pin 78, and thereafter, rotation of the key crank 60 causes the latch 80 to rotate further about the fixed pin 82 through the intermediate position shown in FIG. 6 to the fully locked position shown in FIG. 7.

Figure 7:
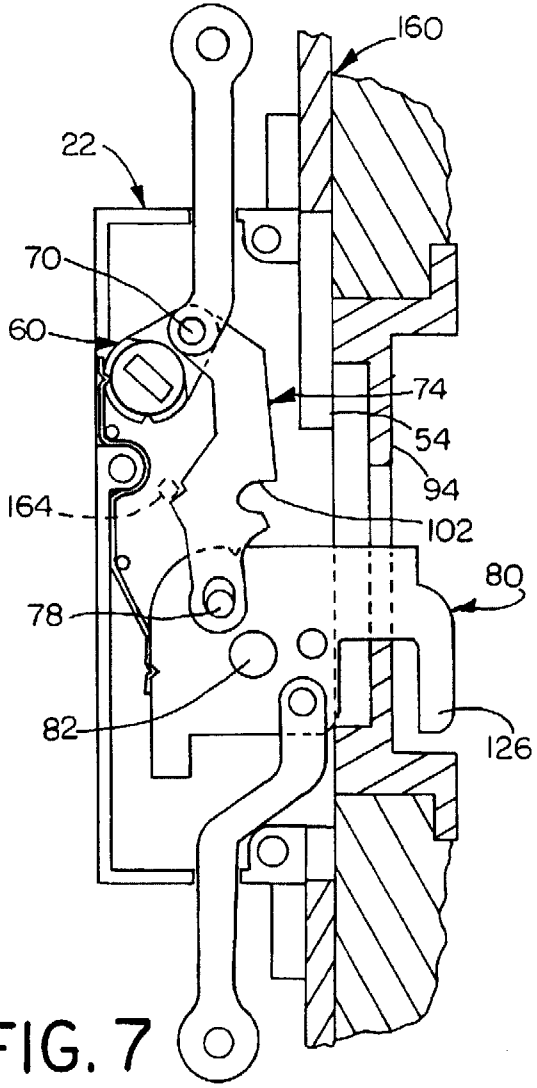

Once the lock 22 is in the fully locked position shown in FIG. 7, the engagement finger 126 which forms a part of the latch 80 is securely positioned behind the striker plate 94, and so the door 20 (FIG. 1) is secured against unauthorized entry.

The main lock 22 includes a leaf spring 130 (FIGS. 3, 5 and 6) which cooperates with notches 132 and 134 on the latch 80 and notches 136 and 138 on the key crank 60. The spring 130 is held in place by two pins 140 and 142 in the housing 40 which are located on opposite sides of a boss 144. The spring 130 wraps around the boss 144 and at its opposite ends is formed with detents 146 and 148 which cooperate with the notches 132 and 134 on the latch 80 and the notches 136 and 138 on the key crank 60, respectively, to hold the latch in the fully open position of FIG. 4 or the fully locked position of FIG. 7.

The main lock 22 has an anti-burglary feature which prevents opening the lock when it is in the fully locked position shown in FIG. 7 except by operation of the key crank 60. This feature is specifically intended to make it difficult for the lock to be opened by, for example, inserting a credit card or knife in the gap 160 (FIG. 7) between the front face 54 of the main lock 22 and the striker plate 94 so as to lift the latch 80 upward. To this end the link 74 includes a bight or notch 162 in its back or left edge approximately opposite the safety slot 102. The notch 162 cooperates with a stop element or tang 164 which projects in toward the interior of the lock 22 from the cover plate. The tang 164 is shown in dotted line in FIGS. 4–7 for purposes of explanation because in those Figures, the cover plate 42 has been removed to show the operation of the linkage within. The tang 164 is formed by a lancing operation in which the cover plate 42 is formed. This operation shears the metal along three sides of a square and forces the free edge 166 (FIGS. 5 and 6) downward so that it projects into the interior of the lock 22.

The cooperation of the notch 162 and tang 164 may be explained as follows. With the lock 22 in the locked position shown in FIG. 7, upward movement of the latch 80 would initially cause the latch to rotate counterclockwise about fixed pin 82. This in turn would cause the pin 78 to have a component of its motion to the left, causing the link 74 to rotate clockwise around the axis of the crank pin 70. Such motion of the link 74 is prevented because the tang 164 is positioned so as to engage the notch 162. On the other hand, if the key crank 60 is operated to open the lock, the key crank 60 is rotated clockwise from the position shown in FIG. 7. This initial motion causes the crank pin 70 to move to the right and downward from its one o'clock position. This in turn causes the initial motion of the link 74 to be a clockwise rotation of the link 74 about the pin 78. The downward component of motion of the crank pin 70 is accommodated by the lost motion connection between the link 74 and latch 80. As shown in FIG. 7 the latch 80 is in its engaged position and the extra space of the lost motion connection is above the pin 78 because the link 74 has most recently been used to pull the pin 78 upward. Therefore, when the crank pin 70 reverses direction, moving downward and to the right, the link 74 is free to move downward enough to clear the notch 162. The notch 162 is positioned and proportioned so that such initial rotation of the link 74 in response to the initial rotation of the key crank 60 in a clockwise direction is enough to allow the notch 162 to clear the tang 164 and so to open the lock 22 by lifting the latch 80.

As noted above, the main lock 22 is adapted to have one or two remote locks added. The main lock includes the top bar 180 which moves up and down as the main lock 22 moves between the positions shown in FIGS. 4 and 7. As shown in FIG. 2, the top bar has a circular opening 182 in its top end 184. The upper connecting rod 34 has a hooked lower end 204 which is pivotally connected to the top end 184 of the top bar 180. The lower end 204 of the upper rod 34 may be secured in place by any conventional means such as a cotter pin or a threadless fastener similar to a Tinnerman nut.

The lower end portion of the top bar 180 has a slight dog leg shape to clear the bearing surface 62 of the key crank 60, and the top bar terminates in an opening 208 which fits over the crank pin 70. The top bar 180 passes through a slot 210 formed in the top of the housing 40. As a result of the connection between the key crank 60 and the top bar 180, rotation of the key crank makes the top bar move up and down.

Figure 8:
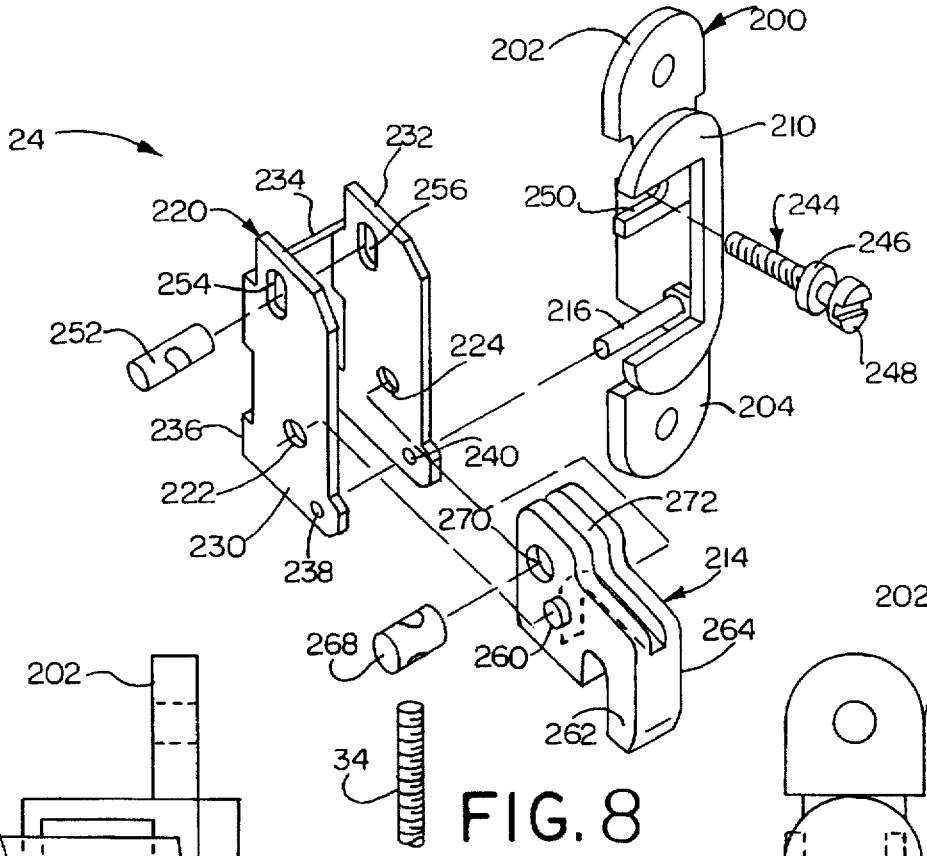
FIG. 8 is an exploded perspective view of a remote lock used in connection with the present invention.

The upper remote lock 24 is shown in an exploded view in FIG. 8. The upper remote lock 24 includes a housing 200 which includes a pair of flanges 202 and 204, top and bottom, which have threaded passages to receive machine screws to secure it in place inside the channel 52 (FIG. 1). The housing has a front face 210 which is generally oval with a large rectangular opening 212 through which the latch 214 extends when the lock 24 is locked.

The housing includes a pin 216 which extends parallel to the front face 210 and horizontally when the lock 24 is installed in the usual manner. The pin 216 is shown as integrally formed with the housing 200, but it could also be press fit into an opening formed for that purpose in the housing. The pin 216 forms a pivot for the latch adjuster 220.

The latch adjuster 220 carries the latch 214, providing it with journal surfaces 222 and 224 which define the axis about which the latch may pivot to move between locked and unlocked positions. The latch adjuster is generally an u-shaped stamped steel member with two parallel sides 230 and 232 joined by a pair of cross members 234 and 236. The sides 230 and 232 of the latch adjuster 220 have a pair of openings 238 and 240 which are aligned with each other and proportioned to slide over the pin 216 on the housing 200. Once the latch adjuster 220 is installed on the pin 216, the latch adjuster is free to rock about the pin. The top of the pin 216 may be upset to retain the latch adjuster 220 in position. If the pin 216 is pressed in place, it may be provided with an integral head to retain the latch adjuster in place.

Movement of the latch adjuster about the pin 216 is controlled by an adjusting screw 244. This adjusting screw 244 has an annular collar 246 spaced a short distance from the head 248. The housing 200 has a slot 250 which receives the adjusting screw 244. When the adjusting screw 244 is in place, its axis is generally perpendicular to the plane of the front face 210. The screw 244 is free to rotate in the slot 250, but the head 248 and collar 246 prevent axial movement of the screw 244.

Figure 9:
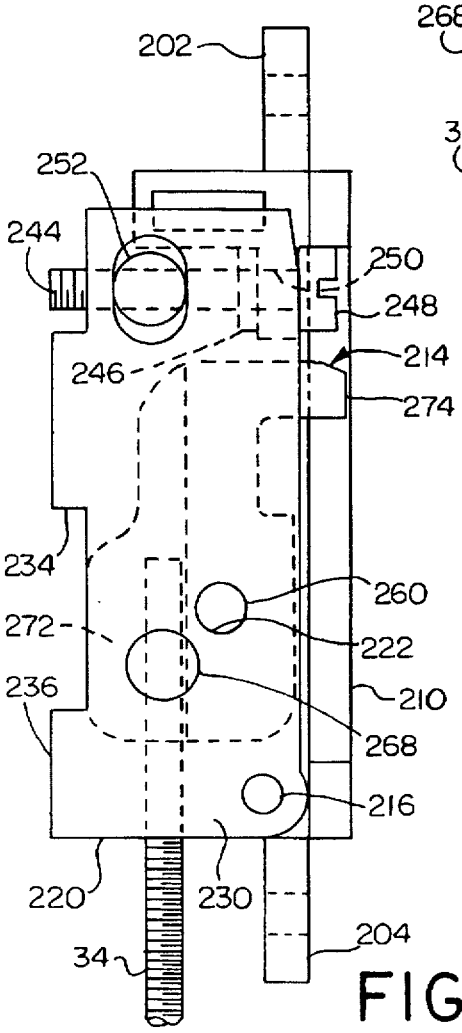
FIG. 9 is a side elevation view of the remote lock of FIG. 8.
Figure 10:
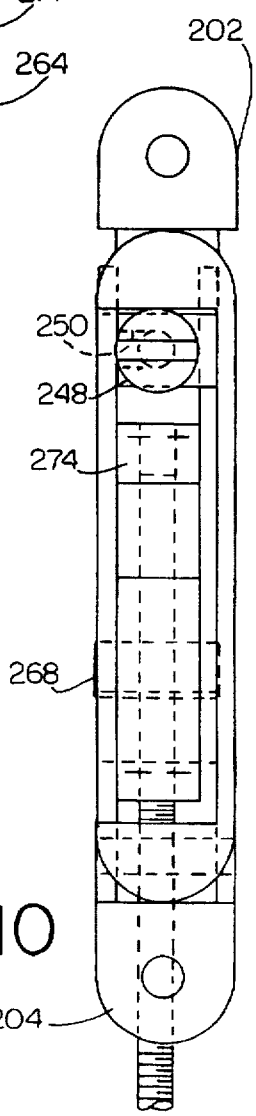
FIG. 10 is a front elevation view of the lock remote lock of FIG. 9.

The end of the adjusting screw 244 opposite from the head 248 is threaded, and this threaded portion is screwed into a barrel nut 252 after the barrel nut has been centered in two passages 254 and 256 formed in the sides 230 and 232, respectively, of the latch adjuster 220. The adjusting screw 244 and the barrel nut 252 cooperate to cause the adjuster keeper to pivot about the pin 216 as the adjusting screw is turned. The passages 254 and 256 may be slightly elongated as shown in FIG. 9 to accommodate the vertical motion of the barrel nut 252 as the latch adjuster 220 rocks about the pivot pin 216. Rotating the adjusting screw 244 causes the latch adjuster 220 to pivot about the pin 216, and this in turn changes the reach of the latch 214 when in the extended or operative position shown in FIG. 8 to accommodate variations in the door or door frame that would otherwise interfere with secure locking or the door.

As noted the latch 214 is mounted in the latch adjuster 220. The latch 214 includes a pair of coaxial studs 260 (only one shown) which project in opposite directions from the near and far faces 262 and 264, respectively, of the latch as viewed in FIG. 8. The studs 260 fit into the journal surfaces 222 and 224 in the latch adjuster 220. When the latch 214 is mounted in the latch adjuster 220 by means of the studs 260, the latch can rotate 90° about the axis of the studs 260 and the journal surfaces 222 and 224 from the open position shown in FIG. 9 to a closed position in which the latch is oriented as shown in FIG. 8.

The movement of the latch 214 is controlled by the movement of the upper connecting rod 34. The rod 34 is threaded onto a barrel nut 268 which fits in a passage 270 formed in the latch 214. The passage 270 is parallel to axis of rotation of the latch 214 and extends between the near and far faces 262 and 264 of the latch 214.

The latch 214 also has a slot 272 formed in its peripheral surface. The slot 272 extends around two sides of the latch 214 (the back and the top as shown in FIG. 8) to accommodate the connecting rod 34. The position of the passage 270 in relationship to the studs 260 and the engagement finger 274 of the latch 214 is selected so that when the rod 34 moves upward, the latch is rotated from the open position shown in FIG. 9 to the horizontal position to engage a keeper in the door frame. By proper selection of the length of the connecting rod 34, it is possible to space the main lock 22 and the remote lock 24 by virtually any desired distance.

The horizontal position of the latch 214 when it is in the locked position is determined by the adjusting screw 244. The latch 214 can be made to extend farther from the front face 210 of the housing 200 by turning the screw 244 clockwise to draw the latch adjuster 220 forward, and vice versa. This movement makes it possible to adjust the remote lock 24 for variations in the door frame such as may be caused by warping and by different thicknesses of weather stripping or other variables.

The lower remote lock 26 (FIG. 1) is identical to the upper remote lock 24. However the lower lock 26 is mounted upside down as compared to the upper remote lock 24. This arrangement not only saves manufacturing and inventory costs, but it guarantees that the engagement finger 285 of the lower remote lock 26 faces in the opposite direction from the engagement finger 26 of the upper remote lock 24. With the two engagement fingers facing in the opposite directions, it is virtually impossible for the door 20 to be lifted off its track to gain unauthorized entry while the door is locked.

The lower remote lock is actuated by the lower connecting rod 36 (FIG. 2). This connecting rod 36 threads into a barrel nut (not shown) like the barrel nut 252 (FIG. 8) in the upper remote lock 24. The lower connecting rod 36 has a right angle bend at its upper end which passes through an opening 280 in a bottom bar 282 (FIG. 8). The bottom bar 282 is connected to the latch 80 by means of a pin 284. The pin 284 is positioned on the face of the latch 80 so that when the latch moves clockwise from an initial open position as shown in FIG. 4, the pin moves downward. This downward motion is transmitted to the bottom bar 282 which passes through a slot 286 in the housing 40. This downward motion of the bottom bar 282 is in turn transmitted through the lower connecting rod 36 to the lower lock 26 to move it to a locked position.

From a door manufacturer's point of view the present invention offers a number of advantages. First, the main lock 22 can be used with or without one or both of the remote locks 24 and 26. The manufacturer needs to keep only one style of remote lock in stock, the same being suitable both as the upper and lower remote lock. Moreover the profiles of the main lock and the remote locks are the same as the profiles for commonly installed prior art locks. This means that the door manufacturer can install the lock of the present invention without a change in tooling used to make the required openings in the channel section 52. The spacing between the remote locks and the main lock can vary from installation to installation, and all the manufacturer has to do is provide connecting rods of the appropriate length. If the length is not perfect or if there some variation between doors, that can be accommodated by threading the rod, e.g., the upper control rod 34, more or less through the barrel nut 268. In addition, the main lock is tamper resistant, and the latch cannot be extended unless the safety button has been pressed against the striker plate. This virtually guarantees that the latch will not be extended unless the door is closed. In addition, a home owner can purchase a door with just the main lock 22 installed and at a later time one or more remote locks 24 and 26 can be added.

What is claimed is:

1. A lock assembly for securing a door to a door frame, said assembly comprising a latch moveable between a retracted position in which the door is free to be opened or closed and an extended position in which the latch engages the door frame to hold the door closed, an input member movable from a first position to a second position to move the latch to the extended position, a linkage connected between the input member and the latch, the linkage having a first position in which it blocks transmission of motion from the input member through the linkage to the latch and a second position in which the motion of the input member is transmitted through the linkage to the latch, and an engagement button positioned to contact the door frame as the door is approaching the closed position, the engagement button being connected to the linkage to cause the linkage to move from its first position to its second position when the door reaches the door frame.

2. The assembly of claim 1 wherein the input member is rotatable about a first fixed axis and includes a crank pin offset from the axis of rotation of the input member, said linkage being connected to the crank pin.

3. The assembly of claim 2 wherein the latch is rotatable about a second fixed axis between its retracted and extended positions, and the linkage includes a link extending between the crank pin and the latch.

4. The assembly of claim 3 wherein the linkage includes a lost motion connection.

5. The assembly of claim 4 wherein the lost motion connection is between the link and one of the crank pin and the latch.

6. The assembly of claim 4 wherein the lost motion connection includes a pin connected to one of the latch and link and a slot formed in the other of the latch and link.

7. The assembly of claim 6 wherein the button is connected to the latch.

8. A lock assembly for securing a door to a door frame, said assembly comprising a latch moveable between a retracted position in which the door is free to be opened or closed and an extended position in which the latch engages the door frame to hold the door closed, an input member moveable from a first position to a second position to move a latch to the extended position, a linkage connected between the input member and the latch, the linkage having a first position in which it blocks transmission of motion from the input member through the linkage to the latch and a second position in which the motion of the input member is transmitted through the linkage to the latch, and an engagement button positioned to contact the door frame as the door is approaching the closed position, the engagement button being connected to the linkage to move the linkage from its first position to its second position when the door reaches the door frame, the input member being rotatable about a first fixed axis and including a crank pin offset from the axis of rotation of the input member, said linkage being connected to the crank pin, the latch being rotatable about a second fixed axis between its retracted and extended positions, the linkage including a link extending between the crank pin and the latch, and including a lost motion connection between the link and one of the crank pin and the latch, the lost motion connection including a pin connected to one of the latch and link, and wherein the button is integrally formed with latch.

9. The assembly of claim 3 including a housing, the housing having journals to define the first fixed axis of rotation of the actuator and the second fixed axis of rotation of the latch.

10. A lock assembly for securing a door to a door frame, said assembly comprising a latch moveable between a retracted position in which the door is free to be opened or closed and an extended position in which the latch engages the door frame to hold the door closed, an input member moveable from a first position to a second position to move a latch to the extended position, a linkage connected between the input member and the latch, the linkage having a first position in which it blocks transmission of motion from the input member through the linkage to the latch, and a second position in which the motion of the input member is transmitted through the linkage to the latch, and an engagement button positioned to contact the door frame as the door is approaching the closed position, the engagement button being connected to the linkage to move the linkage from its first position to its second position when the door reaches the door frame, the input member being rotatable about a first fixed axis and including a crank pin offset from the axis of rotation of the input member, said linkage being connected to the crank pin, the latch being rotatable about a second fixed axis between its retracted and extended positions, the linkage including a link extending between the crank pin and the latch, the assembly including a housing, the housing having journals to define the first fixed axis of rotation of the actuator and the second fixed axis of the latch, and wherein the linkage includes a moveable pin, and a recess in the link for receiving the pin, the pin being in the recess when the linkage is in the first position so as to block transmission of motion of the input member to the latch, and the pin being free of the recess when the linkage is in the second position so as to permit the linkage to transmit motion of the input member to the latch.

11. The assembly of claim 10 wherein the pin is operatively connected to the button.

12. The assembly of claim 11 wherein the pin is fixed to the latch.

13. The assembly of claim 11 wherein the button is integrally formed with the latch and the pin is fixedly connected to the latch.

14. A lock assembly for securing a door to a door frame having a generally vertical frame member and first and second keepers mounted to the frame member, said lock assembly comprising a main lock mounted to the door and having a main latch moveable between an engaged position in which the main latch engages the first keeper in the door frame to hold the door in a closed position and a retracted position in which the main latch is free of the first keeper and the door is free to move with respect to the door frame, an input member, a main linkage between the input member and the main latch, the input member being moveable to cause the main linkage to move the main latch between the engaged and retracted positions, a remote lock having a housing mounted to the door a remote latch moveable between an engaged position in which the remote latch engages the second keeper in the door frame to hold the door in a closed position and a retracted position in which the remote latch is free of the second keeper and the door is free to move with respect to the door frame, a latch adjuster movably mounted to the housing, said remote latch being movably mounted to the adjuster, a positioner connected between the latch adjuster and the housing to select the relative positions of the remote latch and housing so as to select the position of the remote latch in the engaged position with respect to the door, and a remote linkage connected between the main lock and the remote lock to operate the main and remote latches in synchronism, and wherein the housing includes a pivot pin and the adjuster is pivotable about the pivot pin.

15. The lock assembly of claim 14 where in the remote latch is rotatable between its engaged and retracted positions about an axis that is fixed with respect to the adjuster.

16. The assembly of claim 15 wherein the remote latch is journalled to the adjuster.

17. The assembly of claim 16 wherein the positioner includes a nut and bolt assembly.

18. The assembly of claim 17 wherein housing has a face that is parallel to an edge of the door and the bolt has a head that is exposed on that face.

19. The assembly of claim 18 wherein the bolt has an annular shoulder spaced from the head, and the housing has a slot, the portion of the bolt between the head and shoulder being freely received in the slot whereby the bolt is free to rotate with respect to the housing but is constrained by the head and shoulder against axial movement.

20. The assembly of claim 17 wherein the nut is a barrel nut, and the adjuster includes a passage to receive the barrel nut.

21. A lock assembly for securing a door to a door frame having a generally vertically frame member and first and second keepers mounted to the frame member, said lock assembly comprising a main lock mounted to the door and having a main latch moveable between an engaged position in which the main latch engages the first keeper in the door frame to hold the door in a closed position and a retracted position in which the main latch is free of the first keeper and the door is free to move with respect to the door frame, an input member, a main linkage between the input member and the main latch, the input member being moveable to cause the main linkage to move the main latch between the engaged and retracted positions, a remote lock having a housing mounted to the door a remote latch moveable between an engaged position in which the remote latch engages the second keeper in the door frame to hold the door in a closed position and a retracted position in which the remote latch is free of the second keeper and the door is free to move with respect to the door frame, a latch adjuster movably mounted to the housing, said remote latch being movably mounted to the adjuster, a positioner connected between the latch adjuster and the housing to select the relative positions of the remote latch and housing so as to select the position of the remote latch in the engaged position with respect to the door, and a remote linkage connected between the main lock and the remote lock to operate the main and remote latches in synchronism, and wherein the remote linkage connecting the main and remote locks includes a rod having one end pivotably connected to the remote latch and an opposite end operatively connected to the input member.

22. The assembly of claim 20 wherein the main lock includes a main housing, and the input member is journalled for rotation about an axis that is fixed with resect to the main housing, the input member having a crank pin offset from the fixed axis of rotation of the input member, and a connecting bar having one end portion pivotably connected to the crank pin and an opposite end connected to said opposite end of said rod to effect said operative connection between the input member and the rod.

23. The assembly of claim 22 wherein the main latch is rotatable in the main housing about a second fixed axis between its retracted and extended positions, and the linkage includes a link extending between the crank pin and the main latch.

24. The assembly of claim 22 wherein the main lock includes a main linkage between the input member and the main latch, the input member being moveable to cause the linkage to move the latch between the engaged and retracted positions.

25. The assembly of claim 24 wherein the main linkage includes a lost motion connection.

26. The assembly of claim 25 wherein the lost motion connection is between the link and one of the crank pin and the main latch.

27. A lock assembly for securing a door to a door frame having a generally vertical frame member and first and second keepers mounted to the frame member, said lock assembly comprising a main lock mounted to the door and having a main latch movable between an engaged position in which the main latch engages the first keeper in the door frame to hold the door in a closed position and a retracted position in which the main latch is free of the first keeper and the door is free to move with respect to the door frame, an input member, a main linkage between the input member and the main latch, the input member being movable to cause the main linkage to move the main latch between the engaged and retracted positions, a remote lock having a housing mounted to the door, a remote latch movable between an engaged position in which the remote latch engages the second keeper in the door frame to hold the door in a closed position and a retracted position in which the remote latch is free of the second keeper and the door is free to move to move with respect to the door frame, a latch adjuster movably mounted to the housing, said remote latch being movably mounted to the adjuster, a positioner connected between the latch adjuster and the housing to select the relative positions of the remote latch and housing so as to select the position of the remote latch in the engaged position with respect to the door, and a remote linkage connected between the main lock and the remote lock to operate the main and remote latches in synchronism, and wherein the main lock includes an engagement button positioned to contact the door frame as the door is approaching the closed position, the engagement button being connected to the main linkage to cause the main linkage to move and from its first position to its second position when the door reaches the door frame.

28. The assembly of claim 27 wherein the button is connected to the main latch.

29. A lock assembly for securing a door to a door frame having a generally vertically frame member and first and second keepers mounted to the frame member, said lock assembly comprising a main lock mounted to the door and having a main latch moveable between an engaged position in which the main latch engages the first keeper in the door frame to hold the door in a closed position and a retracted position in which the main latch is free of the first keeper and the door is free to move with respect to the door frame, an input member, a main linkage between the input member and the main latch, the input member being moveable to cause the main linkage to move the main latch between the engaged and retracted positions, a remote lock having a housing mounted to the door a remote latch moveable between an engaged position in which the remote latch engages the second keeper in the door frame to hold the door in a closed position and a retracted position in which the remote latch is free of the second keeper and the door is free to move with respect to the door frame, a latch adjuster movably mounted to the housing, said remote latch being movably mounted to the adjuster, a positioner connected between the latch adjuster and the housing to select the relative positions of the remote latch and housing so as to select the position of the remote latch in the engaged position with respect to the door, and a remote linkage connected between the main lock and the remote lock to operate the main and remote latches in synchronism, and the main lock including an engagement button positioned to contact the door frame as the door is approaching the closed position, the engagement button being connected to the linkage to move the main linkage from its first position to its second position when the door reaches the door frame, the button being connected to the main latch, and wherein the main linkage includes a moveable pin, and a recess in the link for receiving the moveable pin, the moveable pin being in the recess when the linkage is in the first position so as to block transmission of motion of the input member to the latch, and the moveable pin being free of the recess when the linkage is in the second position so as to permit the main linkage to transmit motion of the input member to the main latch.

30. The assembly of claim 29 wherein the moveable pin is operatively connected to the button.

31. The assembly of claim 30 wherein the moveable pin is fixed to the main latch.

32. A lock assembly having a housing, an actuator mounted to the housing for rotation about a first center or rotation, a latch rotatably mounted to the housing for rotation about a second center of rotation, the latch having a finger for engaging a keeper in an associated door frame and being rotatable about the second center of rotation between an extended position to engage the associated keeper and a retracted position in which the finger is free of the keeper, a link connecting the actuator and latch, a first pivot connection between the actuator and the link and a second connection between the link and the latch, the second connection being a lost motion connection which enables both relative rotation and limited translation between the link and the latch, the actuator being rotatable in opposite directions about the first center of rotation between an open position and a closed position to cause the latch to move between its retracted and extended positions, respectively, a stop element mounted to the housing and a bight formed in the link adapted to receive the stop element, the stop element being positioned and proportioned with respect to the actuator, link and latch so that when the latch is in the extended position, a force applied to the latch tending to rotate of the latch toward its retracted position moves the bight into interfering contact with the stop element and further so that when the latch is in the extended position, rotation of the actuator in a direction tending to cause the latch to rotate from its extended position toward its retracted position causes the bight to move away from the stop element.

33. The lock of claim 32 wherein the first and second connections are on opposite sides of a line connecting the first and second centers of rotation when the latch is in its extended position.

34. The lock of claim 33 wherein a normal to a line connecting the first center of rotation and the first pivot connection forms an angle, $\alpha$, with a normal to a line connecting the second center of rotation with the second connection, the angle $\alpha$ being about $90°\pm20°$.

35. The lock of claim 32 wherein the second connection includes a pin fixed to one of the link and latch and a slot formed in the other of the link and latch, the slot extending in the direction of a line between the pin and the first pivot connection.

36. The lock of claim 35 wherein the slot is shaped to permit the pin to move generally parallel to a line extending between the pin and the first pivot connection and generally parallel to a line connecting the second center of rotation and the pin when the latch is in its extended position.

37. The lock of claim 33 wherein the lost motion connection includes a pin and a slot each formed in one of the link and latch and wherein initial movement of the latch caused by a force applied to the finger to move the latch from its extended position causes the link to rotate about the first pivot connection to bring the bight into engagement with the stop element and initial movement of the actuator from its open position causes relative movement between the pin and slot so as to move the bight clear of the stop element.

38. The assembly of claim 32 wherein the housing, actuator, link and latch together form a four bar linkage, the linkage having a first position in which it blocks transmission of motion of the actuator through the linkage to the latch and a second position in which the motion of the actuator is transmitted through the linkage to the latch.

39. The assembly of claim 38 wherein the main lock includes an engagement button positioned to contact the door frame as the door is approaching the closed position, the engagement button being connected to the linkage to move the linkage from its first position to its second position when the door reaches the door frame.

40. The assembly of claim 39 wherein the button is connected to the latch.

41. The assembly of claim 38 wherein the main linkage includes a moveable pin, and a recess in the link for receiving the pin, the pin being in the recess when the linkage is in the first position so as to block transmission motion of the input member to the latch, and the pin being free of the recess when the linkage is in the second position so as to permit the linkage to transmit motion of the input member to the latch.

42. The assembly of claim 41 wherein the main lock includes an engagement button positioned to contact the door frame as the door is approaching the closed position, the engagement button being connected to the linkage to move the linkage from its first position to its second position when the door reaches the door frame.

43. The assembly of claim 42 wherein the pin is operatively connected to the button.

44. The assembly of claim 43 wherein the pin is fixed to the main latch.

45. The lock of claim 32 further including a rod connected to the latch and a remote lock operatively connected to the rod, the remote lock having a remote latch rotatable between an extended position in which the remote latch engages a remote keeper associated with the remote lock and mounted in a generally vertical element of a door frame.

46. The lock of claim 45 wherein the remote lock includes an adjustment for the remote latch which varies the reach of the remote latch when the remote latch is in the engaged position.

* * * * *